US005238464A

United States Patent [19]

Johnson et al.

[11] Patent Number: 5,238,464

[45] Date of Patent: Aug. 24, 1993

[54] PROCESS FOR MAKING FLAME-RESISTANT CELLULOSIC FABRICS

[75] Inventors: James R. Johnson, McLeansville, N.C.; Randolph L. Finley, Florence, S.C.

[73] Assignee: Burlington Industries, Inc., Greensboro, N.C.

[21] Appl. No.: 855,499

[22] Filed: Mar. 23, 1992

Related U.S. Application Data

[63] Continuation of Ser. No. 446,071, Dec. 5, 1989, abandoned, which is a continuation-in-part of Ser. No. 195,858, May 19, 1988, Pat. No. 4,902,300, which is a continuation-in-part of Ser. No. 52,937, May 22, 1987, abandoned, which is a continuation-in-part of Ser. No. 870,892, Jun. 5, 1986, abandoned.

[51] Int. Cl.[5] ..... D06M 13/285; D06M 13/322; C09K 21/12

[52] U.S. Cl. ..... 8/127.1; 8/181; 8/195; 8/584; 8/585; 8/490; 252/608; 252/8.6; 427/342

[58] Field of Search ..... 252/608; 8/181, 195, 8/127.1, 584, 585, 490; 427/342

[56] References Cited

U.S. PATENT DOCUMENTS

| | | | |
|---|---|---|---|
| 3,849,368 | 11/1974 | Anderson et al. | 260/45.8 |
| 3,919,439 | 11/1975 | Perkins | 427/341 |
| 3,922,406 | 11/1975 | Chapin | 427/402 |
| 3,991,019 | 11/1976 | Shim | 260/2.5 |
| 4,066,812 | 1/1978 | Kaupin | 428/265 |
| 4,076,497 | 2/1978 | Freyberg et al. | 8/21 |
| 4,078,101 | 3/1978 | Cole | 427/341 |
| 4,110,509 | 8/1978 | Roth | 428/276 |
| 4,657,558 | 4/1987 | Huxoll | 8/603 |
| 4,693,726 | 9/1987 | Meininger et al. | 8/547 |
| 4,699,625 | 10/1987 | Jenkins | 8/532 |
| 4,732,789 | 3/1988 | Hauser et al. | 427/393.3 |
| 4,750,911 | 6/1988 | Hansen et al. | 8/584 |
| 4,902,300 | 2/1990 | Johnson et al. | 8/642 |
| 4,909,805 | 3/1990 | Smith | 8/127.1 |

FOREIGN PATENT DOCUMENTS

| | | |
|---|---|---|
| 0248553 | 12/1987 | European Pat. Off. . |
| 0249375 | 12/1987 | European Pat. Off. . |
| 2933207 | 10/1978 | Fed. Rep. of Germany . |
| 1531830 | 11/1978 | United Kingdom . |

OTHER PUBLICATIONS

Amer Dyestuff Reporter May 6, 1968 Proceed Amer Assn Textile Chemists & Colorists "Study of Fire Retardancy of Polyester/Cotton Sheeting", pp. 40–44.

Chemical Extracts 40–Textiles vol. 98 1983, p. 81 No. 217132c "Fireproofing of synthetic fabrics" Teijin.

"Dyeing and Chemical Technology of Textile Fibres" pp. 248–249 Shrink-Resist and other Finishes.

*Primary Examiner*—Paul Lieberman
*Assistant Examiner*—Bradley A. Swope
*Attorney, Agent, or Firm*—Nixon and Vanderhye

[57] ABSTRACT

Cellulosic fabrics are rendered flame resistant in a two-step procedure by applying first a tetrakis(hydroxymethyl) phosphonium salt/urea precondensate ammoniated to crosslink and form an insoluble phosphorus-containing polymer within the fiber structure followed by treatment with a tetrakis(hydroxymethyl) phosphonium salt. The two-step process using these chemically related phorphorus-containing flame retardants provide sufficient phosphorus in and on the cellulosic fabric to impart a predetermined minimum flame resistance. Cellulosic fabrics, primarily cotton, having flame resistant properties durable to washing yet retaining pliant, nontstiff hand result.

8 Claims, No Drawings

PROCESS FOR MAKING FLAME-RESISTANT CELLULOSIC FABRICS

CROSS-REFERENCE TO RELATED APPLICATIONS

This is a continuation of application Ser. No. 07/446,071, filed Dec. 5, 1989, now abandoned which is a continuation-in-part of Ser. No. 07/195,858, filed May 19, 1988, now U.S. Pat. No. 4,902,300, which is a continuation-in-part of Ser. No. 07,052,937 filed May 22, 1987, now abandoned which is a continuation-in-part of Ser. No. 06/870,892, filed Jun. 5, 1986, now abandoned.

TECHNICAL FIELD OF THE INVENTION

This invention relates generally to treating textile fabrics to impart flame resistance. In particular, cellulosic fabrics are treated with tetrakis(hydroxymethyl) phosphonium salts to impart flame resistance.

Cellulosic fabrics are continuously dyed on a commercial scale according to conventional procedures with mixtures of naphthol, sulfur or vat dyes. The dyes are typically mixed with an antimigration agent, a surfactant, a defoamer and a buffer. In the case of vat dyes, the dye mix is padded and dried on the fabric, cooled on cans, padded with a reducing bath containing sodium hydrosulfite and caustic, then steamed at slightly above atmospheric pressure at about 103° C., rinsed, and oxidized with hydrogen peroxide or sodium bromate to fix the vat dyes onto the cotton fibers. The dyed substrate is then scoured in hot water to remove any unfixed dyestuffs and auxiliary materials and finally dried, usually over several steam cans.

Conventional procedures for flame retardant treating 100% cotton substrates use an ammonia cure method that incorporates gaseous ammonia with a tetrakis hydroxymethyl phosphonium salt urea precondensate to form an insoluble polymer within the substrate Several patents, notably U.S. Pat. Nos. 4,494,951 and 4,078,101, extend the efficiency of this concept by adding water or ammonium hydroxide and reammoniating the substrate. While this increases fixation, it does little to improve the appearance and performance of the substrate upon laundering. When higher levels of phosphorus are desired to improve flame resistance this method usually results in fabrics that are stiff. Effort has gone into developing a pad/dry/cure method of applying THPS by crosslinking these salts with a difunctional or trifunctional nitrogen-containing reactant compound that forms a three-dimensional polymer in matrix within the substrate as described in GB 2,055,919. This approach typically reduces the strength of the substrate and forms a stiff polymeric matrix.

We have found that the dual application technique developed in our previous applications for poly/cotton blends is fully applicable to 100% cotton substrates, and that we can successfully apply phosphorus at the 3.0% level without adversely affecting hand or physical performance characteristics of the fabric. In fact, the wash and wear appearance performance is enhanced by the treatment. The effect of phosphorus concentration on flammability is well documented. In the second pass of this two pass system, urea is the preferred material for crosslinking; however, trifunctional and difunctional reactant molecules can be also used; see GB 2,055,919 for examples. Using this approach, phosphorus fixed after oxidation was found to be durable to harsh industrial laundering conditions with temperatures at 82° C. and alkalinity resulting in wash water pH values exceeding 11.5.

It is an object of this invention to apply a flame retardant chemical to the cellulosic fabrics to impart a significant level of flame resistance to the fibers, and thereby to produce a fabric with superior flame resistance. Another object of this invention is to provide a flame resistant cellulosic fabric, preferably cotton, having flame resistant properties durable to washing yet retaining a pliant, non-stiff hand.

A preferred aspect of this invention includes a two-step or two-pass process for imparting flame resistance, durable to multiple laundering and repeated washings in hard water while retaining effective flame resistant properties, to a fabric composed of 100% cellulosic fibers, usually cotton fibers. Cellulosic fabrics so treated exhibit only modest shrinkage upon hot water laundering and an acceptable hand while retaining sufficient phosphorus in and on the cellulosic fibers to impart significant flame resistance to the fabric.

The process includes the separate and consecutive application of two known, chemically related phosphorus-containing flame retardants to the fabric. The first is a tetrakis(hydroxymethyl) phosphonium salt/urea precondensate ammoniated to crosslink, condense and fix, then oxidized, forming an insoluble polymer within the fiber structure. Next a tetrakis(hydroxymethyl) phosphonium salt, followed by heating and oxidization, is used to fix sufficient phosphorus to the cellulosic fabric to impart a predetermined minimum flame resistance. Separate applications of either of the two flame retardants in increased amounts leads to higher flame resistance at the expense of a stiff product that is unacceptable for many applications. The two-pass process provides a flame resistant fabric with flame resistance durable to multiple launderings even in hard water.

DETAILED DESCRIPTION OF THE INVENTION

This invention provides a process for improving the flame resistance of cellullosic fabrics.

In finishing cellulosic fabrics to impart flame resistance, the fibers should ideally be treated with specific chemicals to impart flame resistance to them. Tetrakis-(hydroxymethyl) phosphonium salts (henceforth designated THP salts), such as THPS, are very effective for imparting flame resistance to cellulosic materials. This can be accomplished by using either a THP/urea precondensate salt, which is insolubilized with gaseous ammonia, or by using a THP/pad/dry/cure process, or both.

Demonstrated advantages of the invention include: imparting a smoother appearance after dyeing to the fabric; improved shade control; and reduced washdown after multiple home launderings.

The fabrics dyed and flame-retardant finished according to the invention can be in any desired stage of processing, e.g., they can be treated as woven or knit fabrics. One flame retardant process suitable only for cotton fibers which provides satisfactory and durable flame resistance, known as the PROBAN process, consists of treating the cotton fabric with a prepolymer of tetrakis-(hydroxymethyl) phosphonium salt and urea, followed by ammoniation (THP/urea-precondensate/ammonia). The PROBAN process, licensed by Albright & Wilson, is described in the following U.S.

Pat. Nos. 4,078,101; 4,145,463; 4,311,855; and 4,494,951, and GB 2,055,919 A, all to Albright & Wilson, the disclosures of which are hereby incorporated by reference to the extent necessary to explain the THP salt/urea-precondensate process. See also U.S. Pat. No. 4,346,031 to Elgal et al. This process is considered effective and is widely promoted by at least two companies for imparting flame resistance to 100% cotton fabrics.

Several softeners have been tested in conjunction with the THPS/urea mixture to insure that the finished substrate has adequate lubricity. Use of cationic or nonionic softeners in the mix formulation of the second pass treatment is recommended for minimizing the stiffness of the fabric. Anionic softeners result in poor mix stability and can only be used with great difficulty; thus they are not preferred.

The THP/urea-precondensate/ammonia process consists of applying a THP/urea-precondensate to cotton fabric and drying the fabric to about 10 to 15 wt. % of moisture. The cotton fabric is then exposed to gaseous ammonia. The precondensate is insolubilized by the ammonia. Fixation of the precondensate takes place mainly inside of the cotton fiber, thus imparting durability to multiple launderings.

The invention will now be illustrated with reference to the following examples in which all parts and percentages are by weight and temperatures reported in degrees Celsius. Some formulations are expressed on a weight per volume basis with g/l indicating grams per liter. The materials used are more fully described as follows:

Tetrakis-(hydroxymethyl)phosphonium sulfate (THPS), available from Albright & Wilson, Inc., under the name of Retardol S and from American Cyanamid under the name Pyroset TKOW, is a pale, straw-colored liquid that is miscible with water and has a pungent odor. Several related compounds can be used in place of THPS, including tetrakis(hydroxymethyl)phosphonium chloride (THPC), available under the name of Retardol C from Albright & Wilson, and tetrakis-(hydroxymethyl)phosphonium oxalate, available as Pyroset TKS from American Cyanamid Company. The urea precondensate forms of any of the above can also be used.

THPS when mixed with urea and heated strongly form a relatively insoluble polymer, containing both phosphorus and nitrogen, inside and around the cotton fibers. The durability of this polymer is increased further by oxidizing the phosphorus with hydrogen peroxide, and the odor of phosphorus compounds is minimized or eliminated.

The examples presented below compare the results of a single-pass "conventional" flame retarding process for 100% cotton with those for a double-pass procedure which is a subject of the present invention. The examples show the results of repeated industrial laundering on functional characteristics of the treated, laundered cotton fabrics. The results of repeated laundering in hard water of 80 ppm hardness are also shown. The procedural details were as follows:

Fabrics—The fabrics listed in Table I were used in both the single-pass and double-pass procedures. All of the fabrics were made of 100% cotton.

TABLE I

Description of Base Fabrics

| Fabric | Weave | Prepared* Weight oz/yd |
|---|---|---|
| A | 3/1 Twill | 6.2 |
| B | 3/1 Twill | 8.0 |
| C | 5-Harness Sateen | 9.2 |

*Prior to finishing.

Testing Procedures

A. Flame Resistance was evaluated according to Method 5903 of Federal Test Method Standard 191 A. This method evaluates the char length and afterflame time of strips of fabric ignited in a vertical position. Flame resistance was measured on the finished fabrics, as well as after repeated launderings.

Flame resistance was also evaluated according to ASTM D-2863-77, which describes the Limiting Oxygen Index test. The Limiting Oxygen Index measures the minimum oxygen concentration, expressed as volume percent, needed to support candle-like combustion of a sample.

B. Shrinkage in Laundering was measured after repeated industrial launderings conducted at 74° C. and pH 11.5 in softened water of 5 ppm hardness. Additional launderings were conducted under the same conditions, but using water with a hardness of 80 ppm.

C. Durable Press Rating (Appearance) was rated according to AATCC Test Method 124-1984, except that the launderings were conducted as described in B, above.

D. Fabric Hand was rated subjectively.

EXAMPLE I

Single-Pass Process—Dyed, mercerized samples (200–600 yards each) of Fabrics A and B were padded with a bath containing 35, 50 or 60% of Retardol AC, a commercial product of Albright and Wilson containing 65–70% of tetrakis(hydroxymethyl) phosphonium chloride/urea precondensate, equivalent to 10% of phosphorus. Small amounts of wetting agent and other customary finishing assistants were included. The fabrics were padded to a wet pick-up of approximately 77%, frame dried to a moisture content of about 15%, ammoniated, oxidized with hydrogen peroxide solution, padded with a bath containing nonionic penetrant and softener, vacuumed to reduce moisture to 45%, framed at 199° C. and then compressively shrunk.

The flame resistance properties of Fabrics A and B treated with the single-pass process are shown in Table II. As shown by these results, none of the treated fabrics-had phosphorus contents (after oxidation) of more than 2.5%, and the char lengths after treatment increased progressively with repeated launderings.

TABLE II

Flame Resistance Properties of Fabrics Treated by Single-Pass Process

| | | | | Char Length | | | | | |
|---|---|---|---|---|---|---|---|---|---|
| | Retardol | | P Content | Orig. | | After 50 L | | After 100 L | |
| Fabric | AC % | LOI* % | after Oxidn. % | Warp in. | Fill in. | Warp in. | Fill in. | Warp in. | Fill in. |
| A | 35 | 28.0 | 1.9 | — | — | — | — | — | — |

TABLE II-continued

Flame Resistance Properties of Fabrics Treated by Single-Pass Process

| Fabric | Retardol AC % | LOI* % | P Content after Oxidn. % | Char Length Orig. Warp in. | Orig. Fill in. | After 50 L Warp in. | After 50 L Fill in. | After 100 L Warp in. | After 100 L Fill in. |
|---|---|---|---|---|---|---|---|---|---|
| | 50 | 28.5 | 2.0 | 2.6 | 2.4 | 2.8 | 2.9 | 2.9 | 3.0 |
| | 60 | 29.8 | 2.5 | 2.4 | 2.5 | 2.5 | 2.5 | 2.6 | 2.7 |
| B | 35 | 27.2 | 1.6 | — | — | — | — | — | — |
| | 50 | 28.6 | 2.1 | 2.4 | 2.1 | 2.3 | 2.5 | 2.5 | 3.1 |
| | 60 | 29.3 | 2.4 | 2.5 | 2.2 | 2.4 | 2.4 | 3.0 | 3.0 |

*Limiting Oxygen Index.
Note:
None of the treated fabrics exhibited any afterflame in Method 5903.

The physical properties of the treated fabrics are summarized in Table III, and the laundering shrinkages after 1, 10 and 15 industrial launderings are shown in Table IV. As can be seen from Table III, the maximum durable press (appearance) rating was 3.0, and there was no consistent effect of a higher concentration of Retardol AC on the physical properties listed. The hand of the finished fabrics treated by this process was harsh and stiff.

TABLE III

Physical Properties of Fabrics Treated by Single-Pass Process

| Fabric | Bath Conc. Retardol AC % | Durable Press Rating | Breaking Strength Orig. Warp lb. | Breaking Strength Orig. Fill lb. | Tearing Strength Orig. Warp lb. | Tearing Strength Orig. Fill lb. |
|---|---|---|---|---|---|---|
| A | 50 | 3.0 | 159 | 66 | 6.8 | 5.8 |
| | 60 | 3.0 | 169 | 69 | 6.6 | 5.2 |
| B | 50 | 3.0 | 159 | 70 | 6.1 | 5.2 |
| | 60 | 3.0 | 169 | 69 | 5.6 | 4.8 |

TABLE IV

Laundering Shrinkage of Fabrics Treated by Single-Pass Process

| Fabric | Bath Conc. Retardol AC % | After 1 L Warp % | After 1 L Fill % | After 10 L Warp % | After 10 L Fill % | After 25 L Warp % | After 25 L Fill % |
|---|---|---|---|---|---|---|---|
| A | 50 | 2.7 | 1.2 | 8.6 | 1.7 | 10.3 | 2.2 |
| | 60 | 1.7 | .8 | 8.2 | 2.7 | 10.0 | 3.1 |
| B | 50 | 1.9 | .3 | 6.1 | .5 | 7.2 | 1.5 |
| | 60 | 2.5 | +.1 | 6.8 | +.1 | 8.5 | .6 |

Note:
A plus sign signifies expansion.

Table IV shows that the higher concentration of Retardol AC also affected the laundering shrinkage only slightly, but repeated laundering increased the shrinkage, as would be expected.

EXAMPLE II

Double-Pass Process—A 200 yard sample of Fabric C which had received a single-pass treatment with 35% of Retardol AC in the bath was given second-pass treatments containing 10, 20 or 30% or Retardol S together with 2.6%, 5.2% or 7.8% of urea, respectively. In the event that a urea precondensate of Retardol S is used, the precondensate's content of urea must be subtracted from the required amount of urea. Retardol S, a product of Albright and Wilson, is a 75% solution of tetrakis(hydroxymethyl) phosphonium sulfate containing 11.4% of phosphorus. The fabric was again padded, framed at 182° C., oxidized with peroxide solution, framed and compressively shrunk.

Samples of Fabrics A and B were treated in the same manner as described above, except that the second pass was only with a solution containing 30% of Retardol S. The flame resistance properties of Fabrics treated by the double-pass process are given in Table V.

TABLE V

Flame Resistance Properties of Fabrics Treated by the Double-Pass Process

| Fabric | Retardol AC First Pass % | Retardol AC Second Pass % | LOI* % | P Content** % | Char Length Orig. Warp in. | Orig. Fill in. | After 50 L Warp in. | After 50 L Fill in. |
|---|---|---|---|---|---|---|---|---|
| C | 35 | — | 28.0 | 1.9 | — | — | — | — |
| | 35 | 10 | 29.2 | 2.2 | 1.6 | 1.5 | 1.5 | 1.4 |
| | 35 | 20 | 31.7 | 2.7 | 1.6 | 1.6 | 1.6 | 1.6 |
| | 35 | 30 | 33.8 | 3.2 | 1.5 | 1.4 | 1.4 | 1.5 |

*Limiting Oxygen Index.
**After neutralization, and based on original prepared weight of fabric.
Note:
None of the treated fabrics exhibited any afterflame in Method 5903.

A comparison of Tables II and V shows that the double-pass process fixed significantly more phosphorus on the cotton than did the single-pass process, and the char lengths of the double-pass treated cotton were significantly lower, as well. While the single-pass process can be modified to produce higher phosphorus contents (and thus higher flame resistance), the hand of such heavily treated fabrics is unsatisfactorily stiff and firm. In contrast, fabrics treated by the double-pass process have acceptable hand. The double-pass treated fabrics described in Table V retained 95 to 100% of their original phosphorus content after 50 industrial launderings.

Comparison of Tables III and VI shows that the double-pass process produced higher durable press (appearance) ratings. The differences in breaking strength were not significant, while the one-step process showed a slight superiority with respect to tearing strength.

TABLE VI

Physical Properties of Fabrics Treated by the Double-Pass Process

| | Retardol AC | | | Breaking Strength Orig. | | Tearing Strength Orig. | |
|---|---|---|---|---|---|---|---|
| Fabric | First Pass % | Second Pass % | Durable Press Rating | Warp lb. | Fill lb. | Warp lb. | Fill lb. |
| A | 35 | — | — | — | — | — | — |
| | 35 | 30 | 3.5 | 150 | 58 | 5.4 | 3.2 |
| B | 35 | — | — | — | — | — | — |
| | 35 | 30 | 3.5 | 170 | 70 | 5.2 | 3.7 |
| C | 35 | — | — | 169 | 83 | 10.4 | 7.9 |
| | 35 | 10 | 3.2 | 150 | 75 | 10.6 | 6.5 |
| | 35 | 20 | 3.2 | 175 | 86 | 9.6 | 6.3 |
| | 35 | 30 | 3.5 | 169 | 76 | 12.5 | 6.6 |

EXAMPLE III

Effect of Laundering in Hard Water—The fabric samples described in Table V were subjected to repeated industrial launderings at 74° C., using water with a hardness of 80 ppm. Of the double-pass samples, that with the lowest phosphorus content (2.2%) passed the char length criterion of Test Method 5903 originally and after 20 launderings. However, those samples laundered 40, 50 or 60 times in hard water failed the char length test; indeed, they burned their entire length. All of the other samples, with initial phosphorus contents of 2.7 and 3.2%, passed Test Method 5903 even after 60 launderings.

From these results, it can be seen that laundering with hard water reduces the effectiveness of this type of flame resistance treatment, because of the build-up of calcium soaps, as revealed by calcium analyses. When the initial phosphorus content is approximately 3% or higher, however, adequate flame resistance after 60 or more launderings is obtained. This high level of phosphorus content can be obtained by use of the double-pass treatment with retention of satisfactory hand and good durable press ratings. In these respects, the double-pass treatment is superior to the best single-pass treatments.

What is claimed is:

1. A process of flame retardant treating a fabric composed of 100% cellulosic fibers comprising the successive steps of:

(1) applying a partial condensate of a tetrakis(hydroxymethyl) phosphonium salt and urea flame retardant to the fabric, ammoniating then oxidizing and drying the fabric to attach a first flame retardant to the fibers; and thereafter (2) applying a treatment of unreacted tetrakis(hydroxymethyl) phosphonium salt plus urea, or other difunctional or trifunctional nitrogen-containing reactant or both to the fabric, oxidizing and then drying the fabric to attach a second flame retardant to the fibers, the combined applications of the first and second flame retardants to the fabric imparting improved flame resistance, durable to laundering to the fabric.

2. The process of claim 1, in which after the first application of each flame retardant the fabric is dried to a moisture content of from 5 to 20% by weight prior to further processing.

3. The process of claim 1, in which an insoluble phosphorus polymer is introduced into and around the cotton fibers.

4. The process of claim 1, in which the cellulosic fibers are cotton.

5. The process of claim 1, in which the treated fabric has a flame resistance as measured by char length according to Method 5903 of Federal Test Method Standard 191A of at most 2.5 inches.

6. The process of claim 5, in which the treated fabric has a flame resistance as measured by char length of at most 2.5 inches following 25 launderings, when measured according to Method 5903 of Federal Test Method Standard 191A.

7. A 100% cellulosic fabric produced by the process of claim 1, with an LOI value of at least 32% after 50 launderings in soft water.

8. A process of flame retardant treating a fabric composed of 100% cotton fibers comprising the successive steps of:

(1) applying a partial condensate of a tetrakis(hydroxymethyl) phosphonium salt and urea flame retardant to the fabric, ammoniating then oxidizing and drying the cotton fabric to attach a first flame retardant to the cotton fibers; and thereafter (2) applying a treatment of unreacted tetrakis(hydroxymethyl) phosphonium salt plus urea, or a difunctional or trifunctional nitrogen-containing reactant or both to the cotton fabric, oxidizing and then drying the fabric to attach a second flame retardant to the fibers, the combined applications of the first and second flame retardants to the cotton fabric providing an insoluble phosphorus polymer is introduced into and around the cotton fibers and imparting improved flame resistance, durable to laundering of the cotton fabric.

* * * * *

UNITED STATES PATENT AND TRADEMARK OFFICE

CERTIFICATE OF CORRECTION

PATENT NO. : 5,238,464

DATED : August 24, 1993

INVENTOR(S) : Johnson et al

It is certified that error appears in the above-indentified patent and that said Letters Patent is hereby corrected as shown below:

Column 3, line 45, delete "form" and replace by --forms--.

Column 8, line 4, delete "other" and replace by --a--.

Column 8, line 49 (claim 8), delete "is".

Signed and Sealed this

Thirty-first Day of May, 1994

Bruce Lehman

*Attest:*

BRUCE LEHMAN

*Attesting Officer*

*Commissioner of Patents and Trademarks*